US007805871B2

(12) United States Patent
Ciarrocchi

(10) Patent No.: US 7,805,871 B2
(45) Date of Patent: Oct. 5, 2010

(54) SYSTEM FOR ASSISTING A GUARDIAN WITH LOCATING AND MONITORING A CHILD AND METHOD OF USING

(76) Inventor: Peter Ciarrocchi, 489 Bristol Pike, Bensalem, PA (US) 19020

( * ) Notice: Subject to any disclaimer, the term of this patent is extended or adjusted under 35 U.S.C. 154(b) by 989 days.

(21) Appl. No.: 11/285,954

(22) Filed: Nov. 23, 2005

(65) Prior Publication Data

US 2006/0162208 A1 Jul. 27, 2006

Related U.S. Application Data

(63) Continuation-in-part of application No. 10/871,744, filed on Jun. 18, 2004, now abandoned.

(60) Provisional application No. 60/480,116, filed on Jun. 19, 2003.

(51) Int. Cl.
*A44C 5/00* (2006.01)

(52) U.S. Cl. ..... 40/633; 283/75

(58) Field of Classification Search ..... 40/633, 40/665, 586; 283/75
See application file for complete search history.

(56) References Cited

U.S. PATENT DOCUMENTS

| | | | | | |
|---|---|---|---|---|---|
| 2,954,620 | A * | 10/1960 | Schneider | 40/633 |
| 3,027,665 | A * | 4/1962 | St John Cody | 40/633 |
| 5,423,574 | A * | 6/1995 | Forte-Pathroff | 283/75 |
| 5,799,426 | A * | 9/1998 | Peterson | 40/633 |
| 5,979,941 | A * | 11/1999 | Mosher et al. | 283/67 |
| 6,058,637 | A * | 5/2000 | Duncan | 40/633 |
| 6,085,449 | A * | 7/2000 | Tsui | 40/1.6 |
| 6,748,687 | B2 * | 6/2004 | Riley | 40/633 |
| 2003/0009921 | A1 * | 1/2003 | McAllister | 40/299.01 |

* cited by examiner

*Primary Examiner*—Gary C Hoge
(74) *Attorney, Agent, or Firm*—Volpe and Koenig, P.C.

(57) ABSTRACT

A system for assisting a guardian in monitoring or locating a child is provided. The system includes a guardian band and a child band having matching indicia. At least a portion of the bands are preferably formed from a highly reflective, retroreflective, iridescent or fluorescent material. A method for assisting a guardian in monitoring or locating a child includes sizing a guardian band, sizing a child band, forming the child band into a loop, and placing the child band about a child's body above the waist.

17 Claims, 17 Drawing Sheets

SYSTEM FOR ASSISTING A GUARDIAN WITH LOCATING AND MONITORING A CHILD AND METHOD OF USING

CROSS REFERENCE TO RELATED APPLICATIONS

This application is a continuation-in-part of U.S. patent application Ser. No. 10/871,744, filed Jun. 18, 2004, which claims the benefit of U.S. Provisional Patent Application No. 60/480,116, filed Jun. 19, 2003, which are incorporated by reference as if fully set forth herein.

FIELD OF INVENTION

The present invention relates to the field of systems for child location and monitoring.

BACKGROUND

When monitoring individuals, especially children in a public venue, there is a need to be able to easily recognize and then identify or locate one or more such individuals visually. This is particularly true with children in crowded situations, such as at a public pool or at the beach, where children have minimal clothing for identification. Any visual indicator can serve to prevent a child from departing from an area in which they are being monitored by a "monitoring individual" or "guardian" such as a parent, baby sitter, adult or older relative, or any other caregiver, such as a baby sitter, nanny, au pair, etc., or may assist in locating individuals who have wandered away from a site at which they are being monitored, or where they should stay put. It is particularly important for guardians to be able to locate, monitor and/or identify children from a distance.

In a crowded situation (class trip, beach, swimming pool, attending a theme park, visiting a park, shopping at a mall, camping trip), there is a need to be able to readily distinguish and recognize one family's child from other children who may be in the vicinity. For example, children may be part of a crowd, making it difficult for a monitoring individual to easily locate and identify the monitored individuals. In such a circumstances, it can be difficult for a parent to readily pick out one or more children from the other children within a crowd. For example, a child on a beach, in or near a swimming pool, the ocean or at a playground, could wander away from a parent. As another example, a child may remain within the vicinity of a monitoring person, but still be difficult to identify or locate as a result of a crowd of others surrounding the child or interposed between the child and the monitoring individual. Moreover, there are many situations where a guardian cannot see a child's face, and therefore, cannot readily monitor or identify the child.

This need to be able to readily identify or locate children, may involve only a single child or multiple children, such as children making up a group undertaking a single activity, for example, a several siblings, or a group of children on a class trip. It would be advantageous to have a visual indicator that can be viewed from afar or in a crowd to locate and identify children, particularly when a child's face is not visible.

Therefore, there is a need for a system including a visual indicator for identifying children that is readily observable from a distance.

There is further the need for a system including a visual indicator that is easily sized and adjustable to meet the specific needs of a guardian and child.

There is even further the need for a visual indicator that can be attached and detached easily to and from a guardian and a child.

There is even further the need for a visual indicator that is worn by both a child, and monitoring individual, where the visual indicator device worn by both has matching elements, which is readily observable from a distance.

The present invention satisfies these needs.

SUMMARY

The present invention is directed to a locator and monitoring system including a band which can be formed into at least one guardian band and at least one child band. The guardian band and child band are formed having matching indicia. In one embodiment, the bands are provided at preselected lengths or strips, including score lines between segments of the band where the bands can be torn. In an alternate embodiment, a combination band is provided as a circle band, with a guardian band provided as a cross band removably attached to the circle band.

BRIEF DESCRIPTION OF THE DRAWINGS

For the purpose of illustrating the invention, there is shown in the drawings various forms that are presently preferred, it being understood, however, that this invention is not limited to the precise arrangements and constructions shown.

DETAILED DESCRIPTION OF THE PREFERRED EMBODIMENTS

Certain terminology is used herein for convenience only and is not to be taken as a limitation on the invention. Particularly, words such as "upper," "lower," "left," "right," "horizontal," "vertical," "outer", "inner", "upward," and "downward" merely describe the configuration shown in the figures. The phrase "are any or all of the following: "A", "B" or "C" shall mean that any of the preceding elements; A, B or C may be present individually, or in any combination; i.e., A and B only, A, B, and C, B and C only, etc.

"Iridescence" or "iridescent" refers to a lustrous rainbow-like play of color caused by differential refraction of light waves that tends to change as the angle of view changes. Iridescence shall also refer to an object or material having a milky brightness, pearlescence, or opalescence. Anything herein described as "iridescent" has the characteristic of iridescence. Pearlescent is included within the definition of iridescent. Having the appearance of a hologram or shimmer film is included within the definition of iridescent. Iridescent includes a bright, metallic finish.

"Highly reflective" shall refer to the ability or capability of a material to reflect light that is highly visible to the human eye.

"Retroreflection" refers to reflection in which there is a pronounced maximum in the backward direction, and a material or object described as being "retroreflective" possesses these properties. "Retroreflector" refers to any object or material used to cause reflected radiation to return along paths parallel to those of their corresponding incident rays.

"Indicia" or "identifying characteristics" refers to any distinctive markings such as color, graphics, text, numbers, images, or letters, or other visible marking, as well as any material characteristics or attributes, such as iridescence, retroreflectivity, fluorescence, or high reflectivity.

As used herein, the phrase "readily observable" refers to the attribute or characteristic of being easily, or without great effort, capable of visual identification without the need for extensive examination or scrutiny.

As used herein, the phrases "readily observable from a distance" or "readily observable at a distance" refer to the attribute or characteristic of being easily, or without great effort, capable of visual identification without the need for extensive examination or scrutiny at a distance of greater than approximately five (5) feet.

"Color" or "colored" refers to any visible color or combination of colors.

The terms "guardian" and "monitoring individual" are used interchangeably and refer to a person charged with monitoring or taking care of a child, such as a parent, grandparent, baby sitter, adult or older relative, nanny, or au pair, or any other monitor or caregiver.

Figure 1:
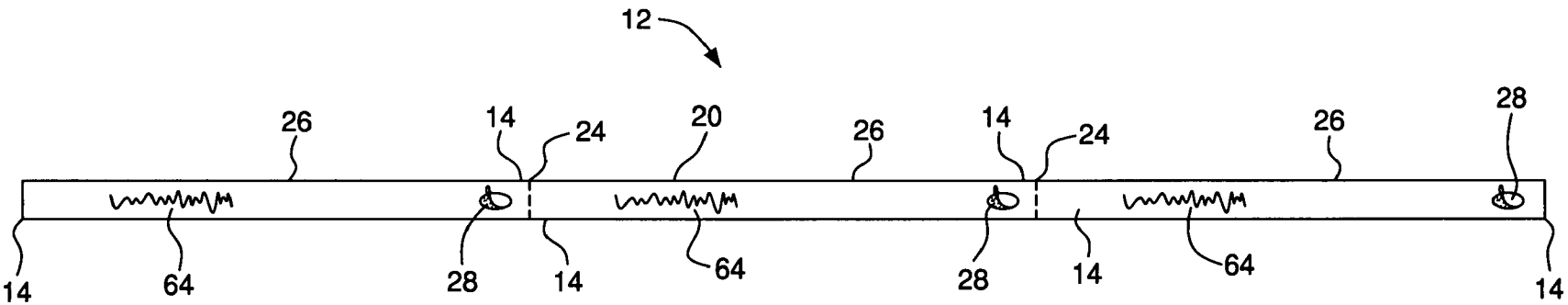
FIG. 1 shows an embodiment of a band having indicia according to the present invention.
Figure 2:
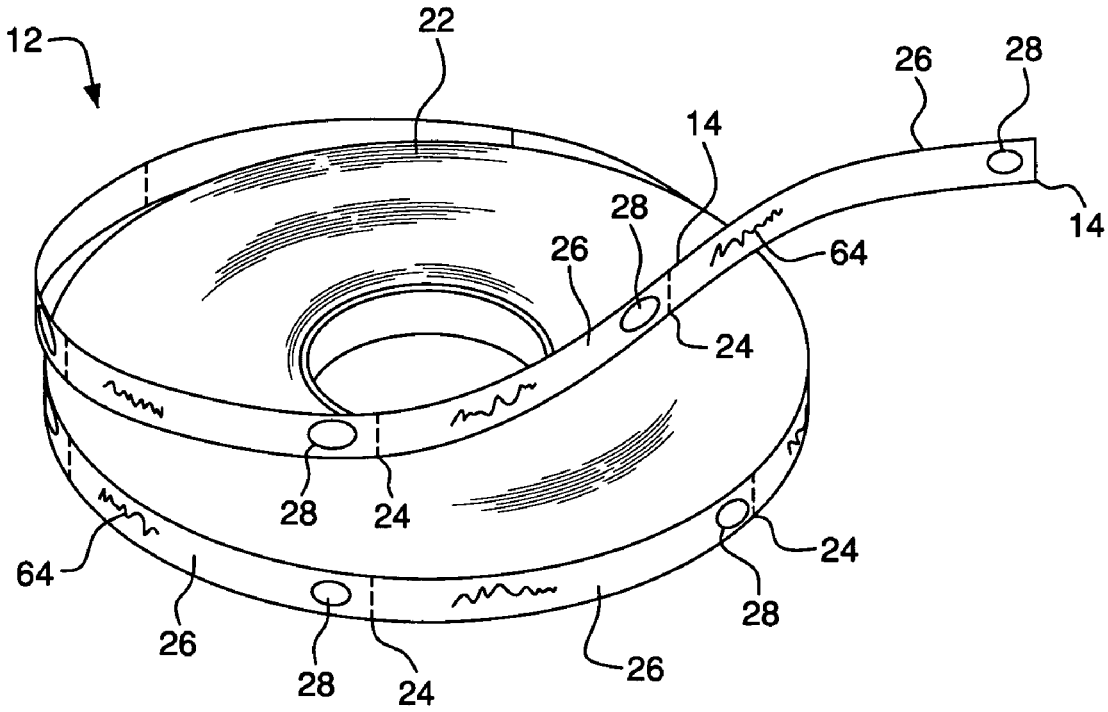
FIG. 2 shows an embodiment of a length of band provided on a roll according to the present invention.
Figure 3:
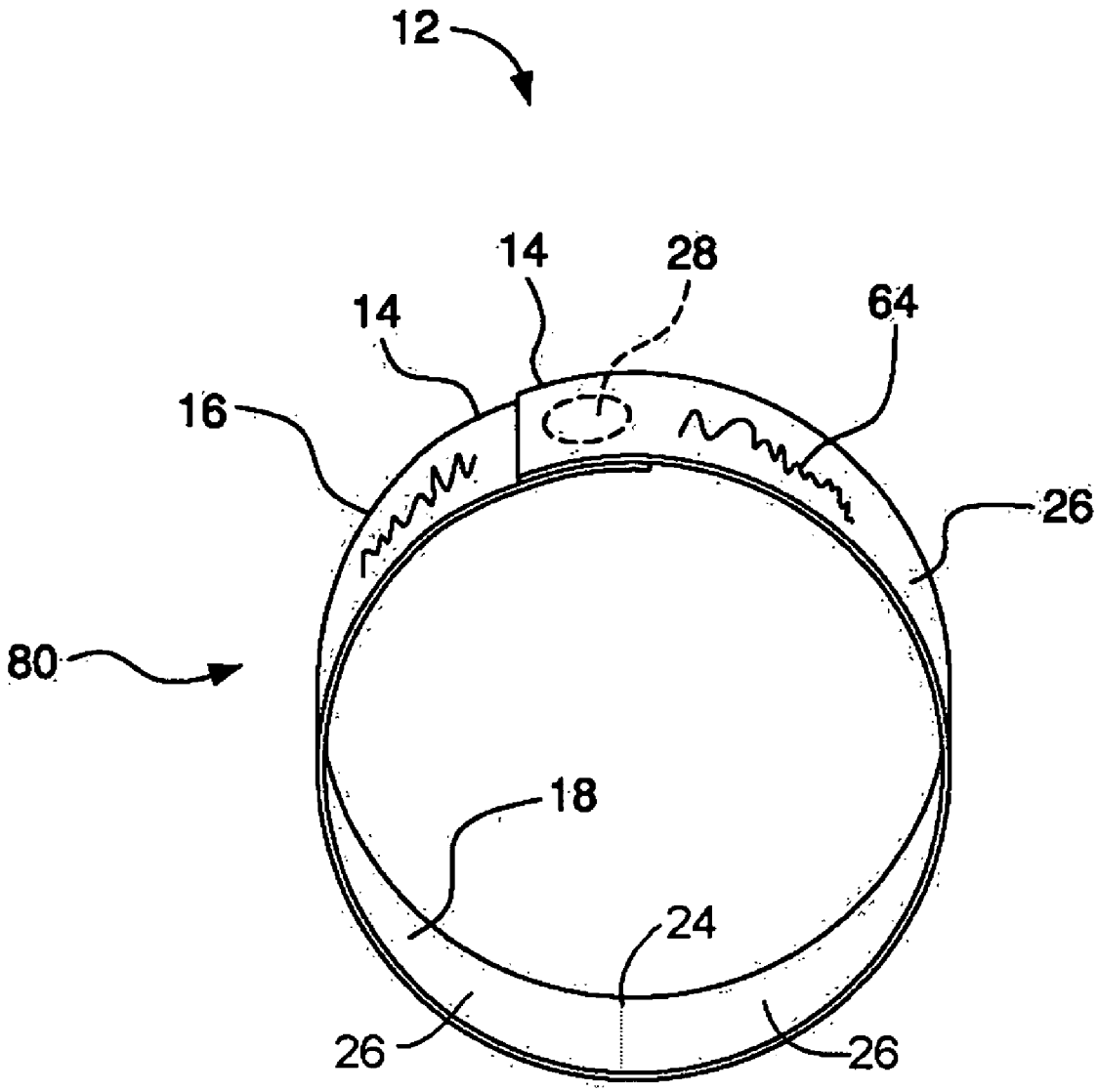
FIG. 3 shows a band of the present invention formed into a loop with fasteners.

As shown in FIG. 1, bands 12 of the locator and monitoring system 10 of the present invention are formed as thin strips 20, approximately 0.5 to 4 inches in width, although the bands 12 may be sized as required for different uses. The bands 12 have opposite ends 14, and first 16 and second faces 18, as shown in FIG. 3. The bands 12 may be pre-formed strips 20 of selected lengths, as shown in FIG. 1, or provided on a roll 22, as shown in FIG. 2. The bands 12 are preferably formed from flexible or elastic materials, such as a plastic, nylon, elastic fabric, reinforced paper, or other acceptable materials, which allow the bands to flex or stretch.

Figure 9:
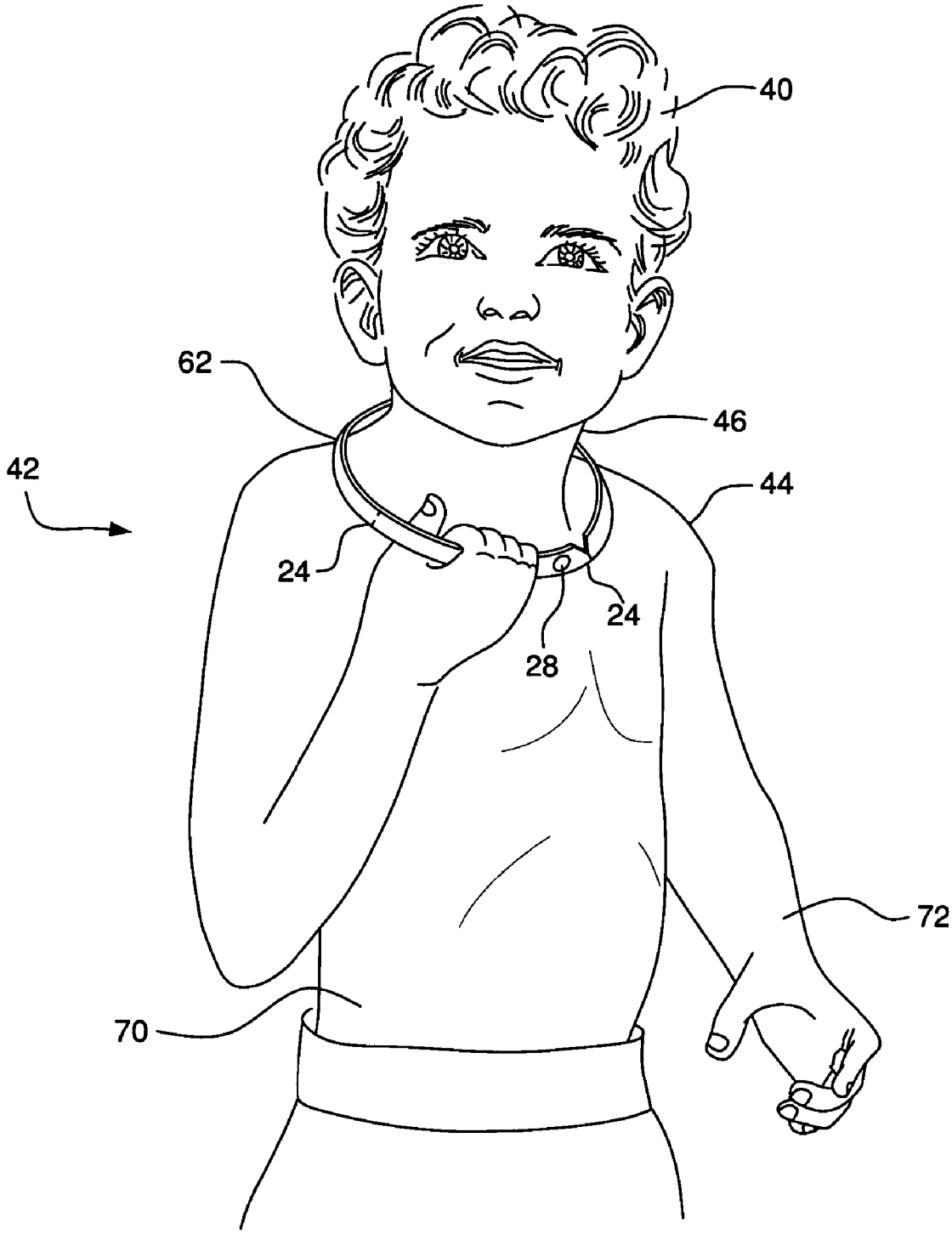
FIG. 9 shows a child tearing a band of the present invention along score lines.

As shown in FIGS. 1, 2, 5*a*, 5*b*, and 9, score lines 24 are provided along the length of the bands 12, providing tear lines for a breakaway arrangement. The scores lines 24 may extend at least partially through the bands 12 to allow the bands to tear along the score lines 24. A plurality of score lines 24 may be provided at separate intervals, as shown in FIGS. 1 and 2, breaking the bands 12 up into discrete segments 26. The score lines 24 allow a user to size the bands 12 to a desired length for wrapping about a neck, wrist, length of hair, arm, or other body part or object. The bands 12 are formed so that by pulling adjacent band segments 26 away from each other, the bands 12 will break or tear long the score lines 24 when a certain amount of force is applied to the bands 12, providing a "breakaway" band, as shown in FIG. 9. Preferably, the bands 12 are adapted to breakaway from each other when a choking-like force is applied. As used herein, the term "choking-like force" means the amount of force necessary to cause a choking hazard or a strangulation hazard. The bands 12 may be formed so that a preselected amount of force applied to adjacent segments 26 will break the score lines 24 joining the adjacent segments 26. It is contemplated that the bands 12 can be attached either tightly, or loosely, depending on the comfort needs of a user.

Figure 4:
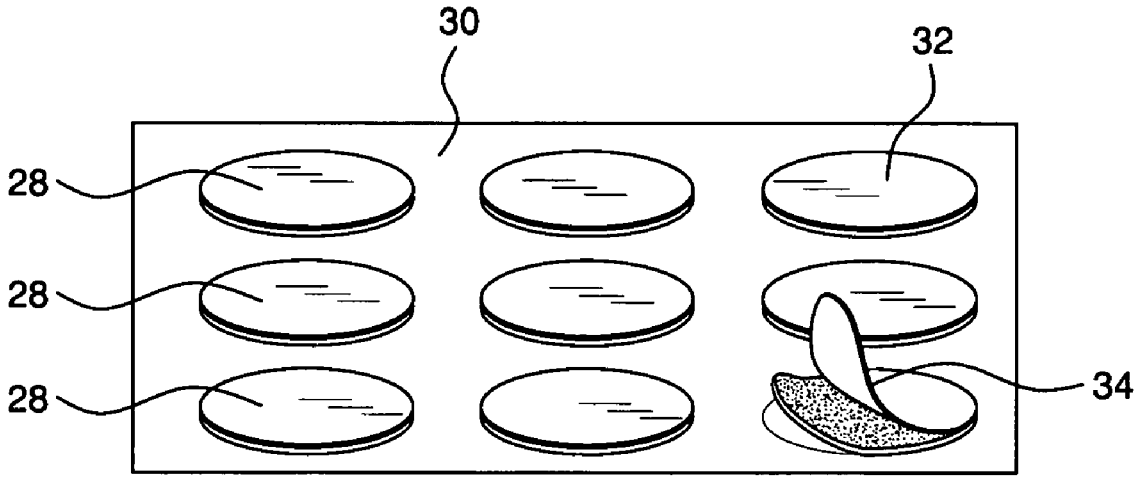
FIG. 4 shows a sheet of fasteners for use in forming loops of bands according to the present invention.

The bands 12 are sized and dimensioned to be shaped into a loops 80 when free ends 14 are affixed with fasteners 28 as shown in FIG. 3. As shown in FIGS. 1, 2 and 3, at least one fastener 28, or plurality of fasteners 28, are provided adjacent at least one end 14 of the bands 12. For example, a fastener 28 may be provided as an adhesive element, which may be a pressure sensitive adhesive tab, double-sided tape, a DUAL LOCK® Fastener, made by 3M Co., a STICKY BACK® Tape pressure sensitive adhesive, or hook and loops attachments such as VELCRO®, at the respective ends 14. Alternatively, the bands 12 may not be provided with fasteners 28, and the fasteners 28 may be provided separately, such as on a separate sheet 30 shown in FIG. 4. The sheet 30 is provided with several double-sided adhesive tabs 32, having pull-off covers 34, that may used to fasten ends 14 of the bands 12, forming loops adapted to act as bracelets, necklaces, hair bands, or for attaching the loops to clothing or other items.

Figure 5A:
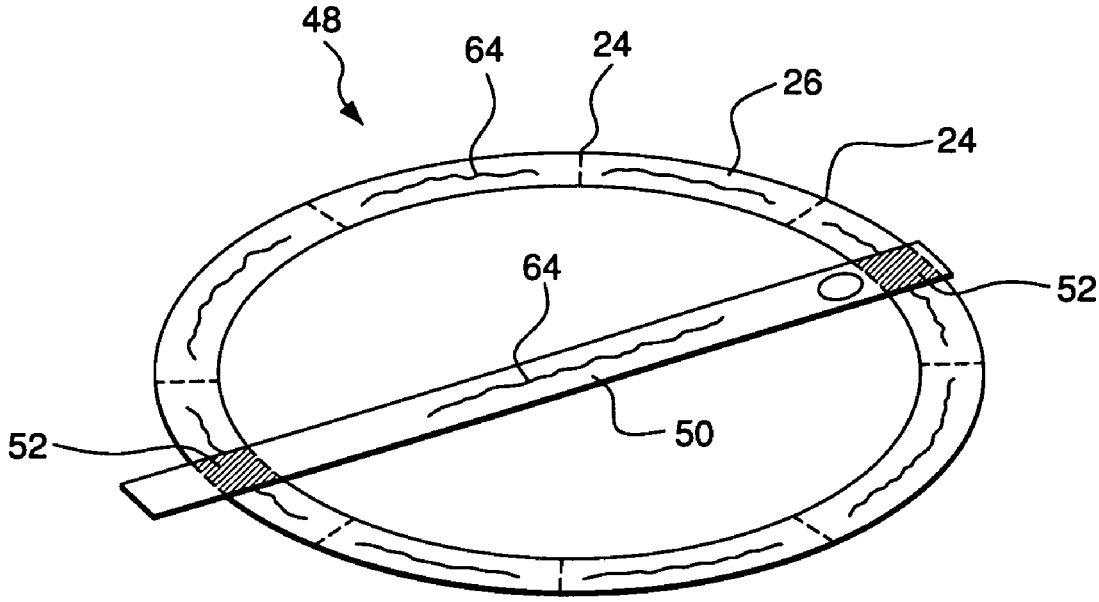
FIG. 5*a* shows an embodiment of a combination band according to the present invention.
Figure 5B:
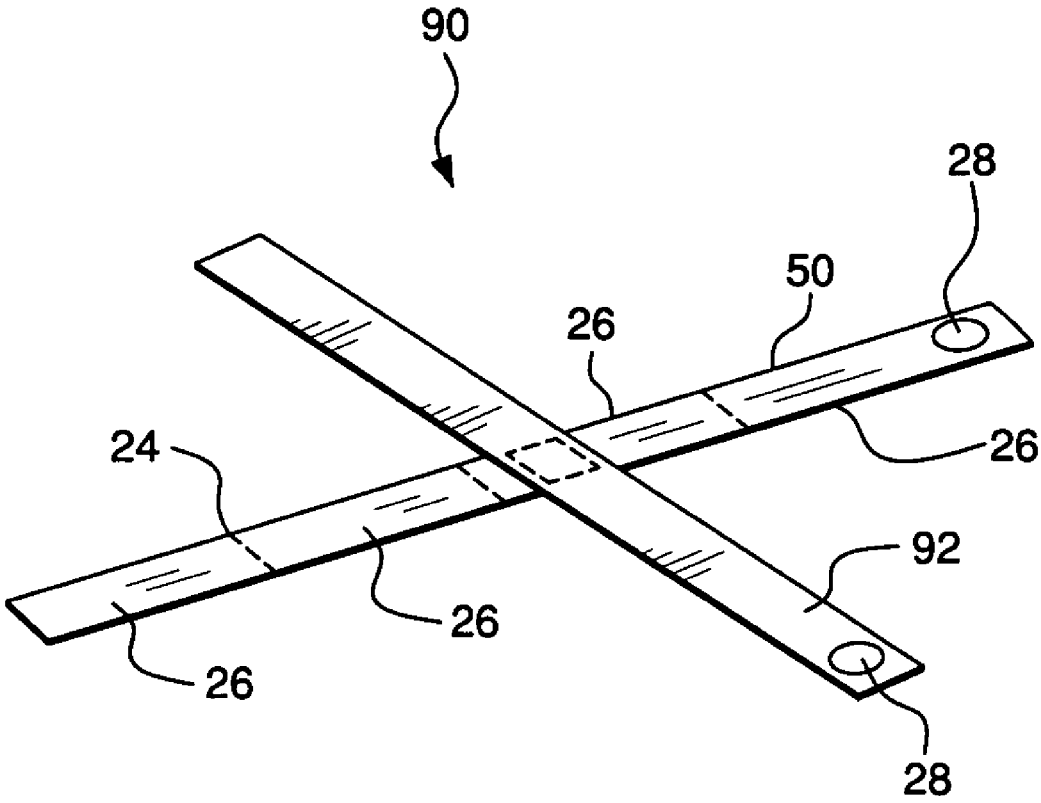
FIG. 5*b* shows a second embodiment of a combination band according to the present invention.
Figure 8:
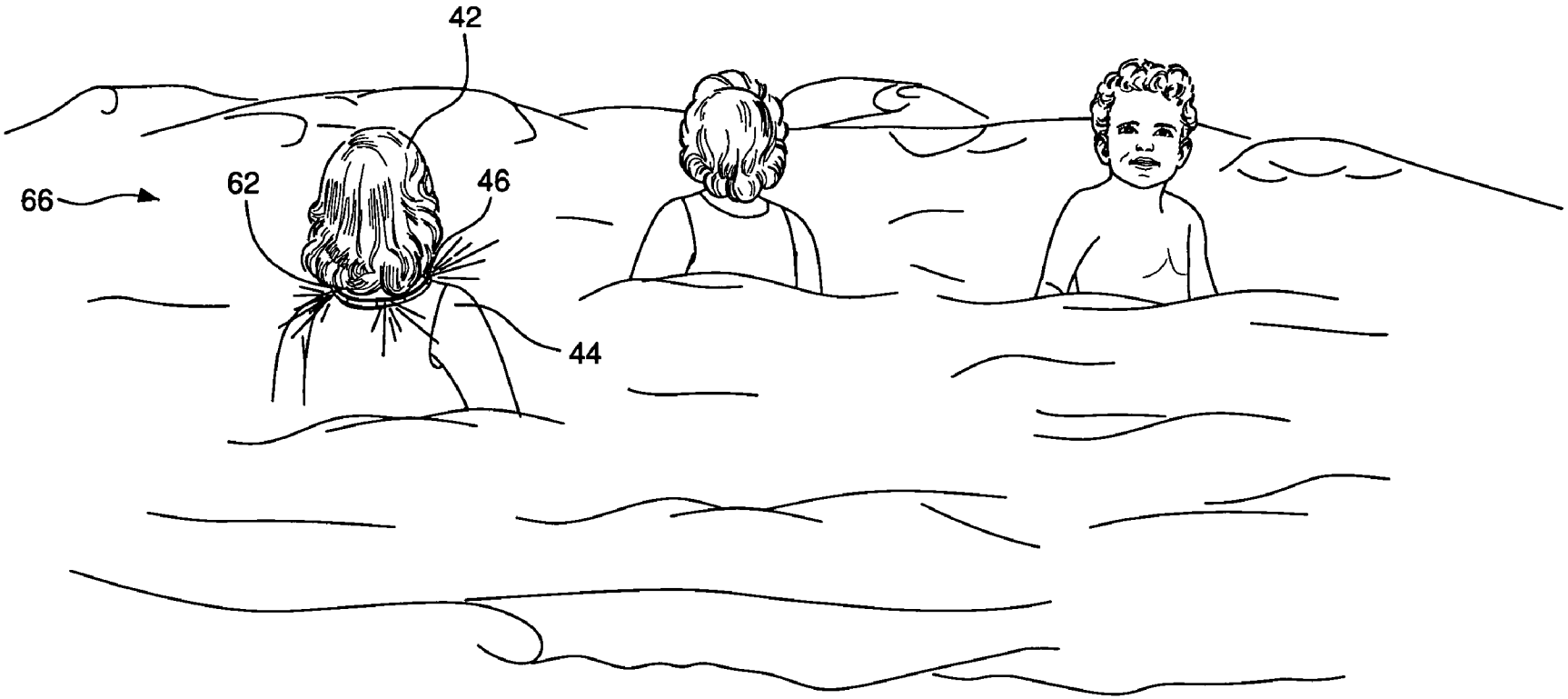
FIG. 8 shows a child utilizing a band of the present invention in the ocean or at the beach.

In an alternate embodiment shown in FIGS. 5*a* and 5*b*, the bands of the present invention May be provided as combination bands. In one embodiment, shown in FIG. 5*a*, a combination band 48 is formed as a substantially flat circular band 36, having segments 26 separated by score lines 24. The circular band 36 defines a neck opening 38 for accepting the head 40 of a child 42. The neck opening 38 may be sized to a range of children's neck sizes, for example, from 8 inches to 16 inches. The circular bands 36 are preferably flat, so that they will lay flat about a child's shoulders 44 adjacent the neck 46, such as is shown in FIG. 8.

In the embodiment shown in FIG. 5*a*, a cross band 50 is affixed to the circular band 36. The cross band 50 is removably attached to the circular band 36 by fastening portions 52, whereby the cross band 50 can be detached from the circular band 36, leaving both intact. The cross band 50 may be fastened to the circular bands 36 by, for example, adhesive, or may be attached by a weld. The cross band 50, when removed from the circular band 36, will act as the guardian band, as explained in more detail below.

In an alternate embodiment shown in FIG. 5*b*, a combination band 90 includes a first band 92, with a cross band 50. The first band 92 and the cross band 50 may be fastened by, for example, adhesive, or may be attached by a weld. The cross band 50, when removed from the first band 92, will act as the guardian band 54, and the first band 92 will act as a child band 62, as explained in more detail below.

Figure 6:
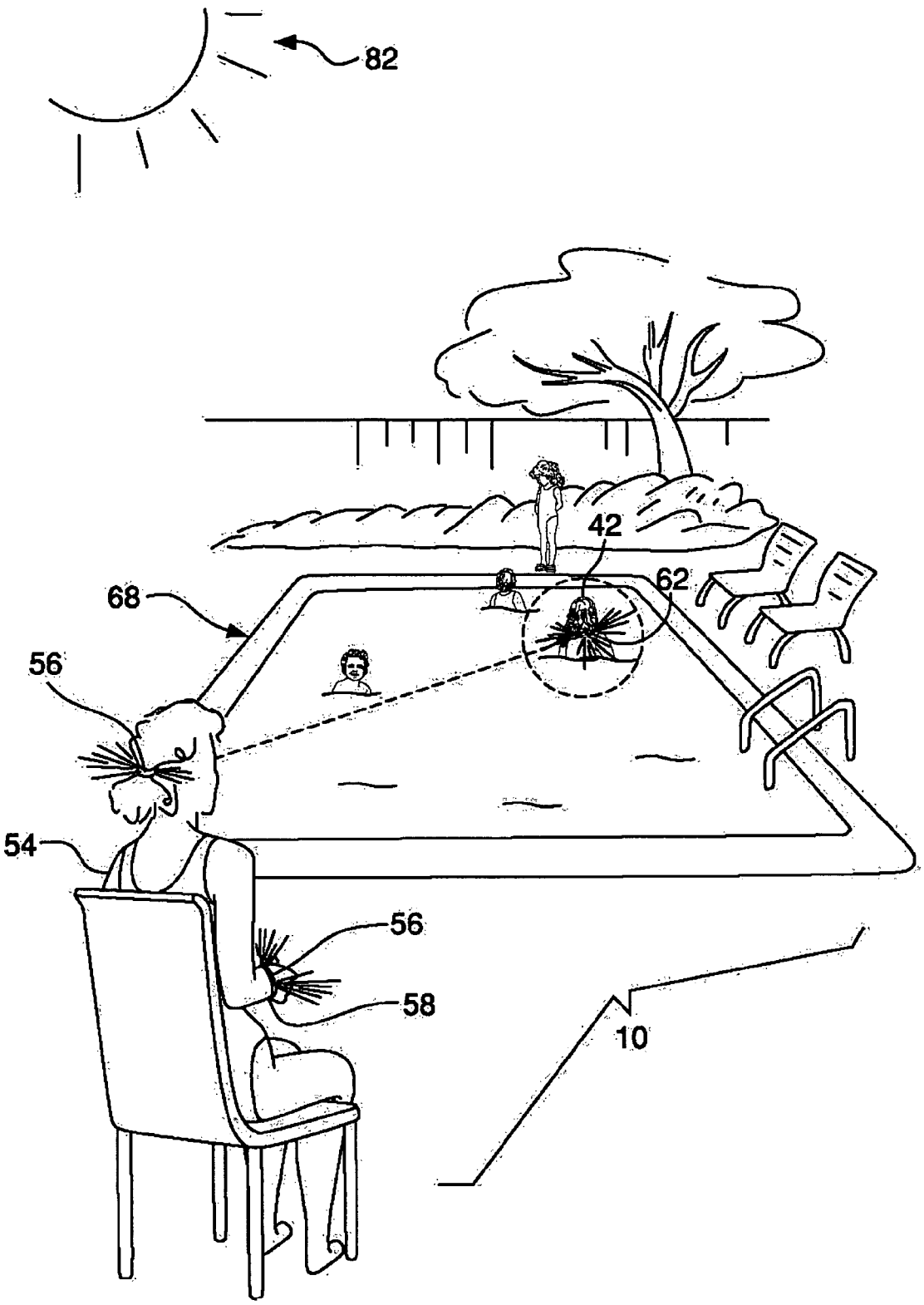
FIG. 6 is a view of a guardian monitoring a child utilizing the bands of the present invention.
Figure 11:
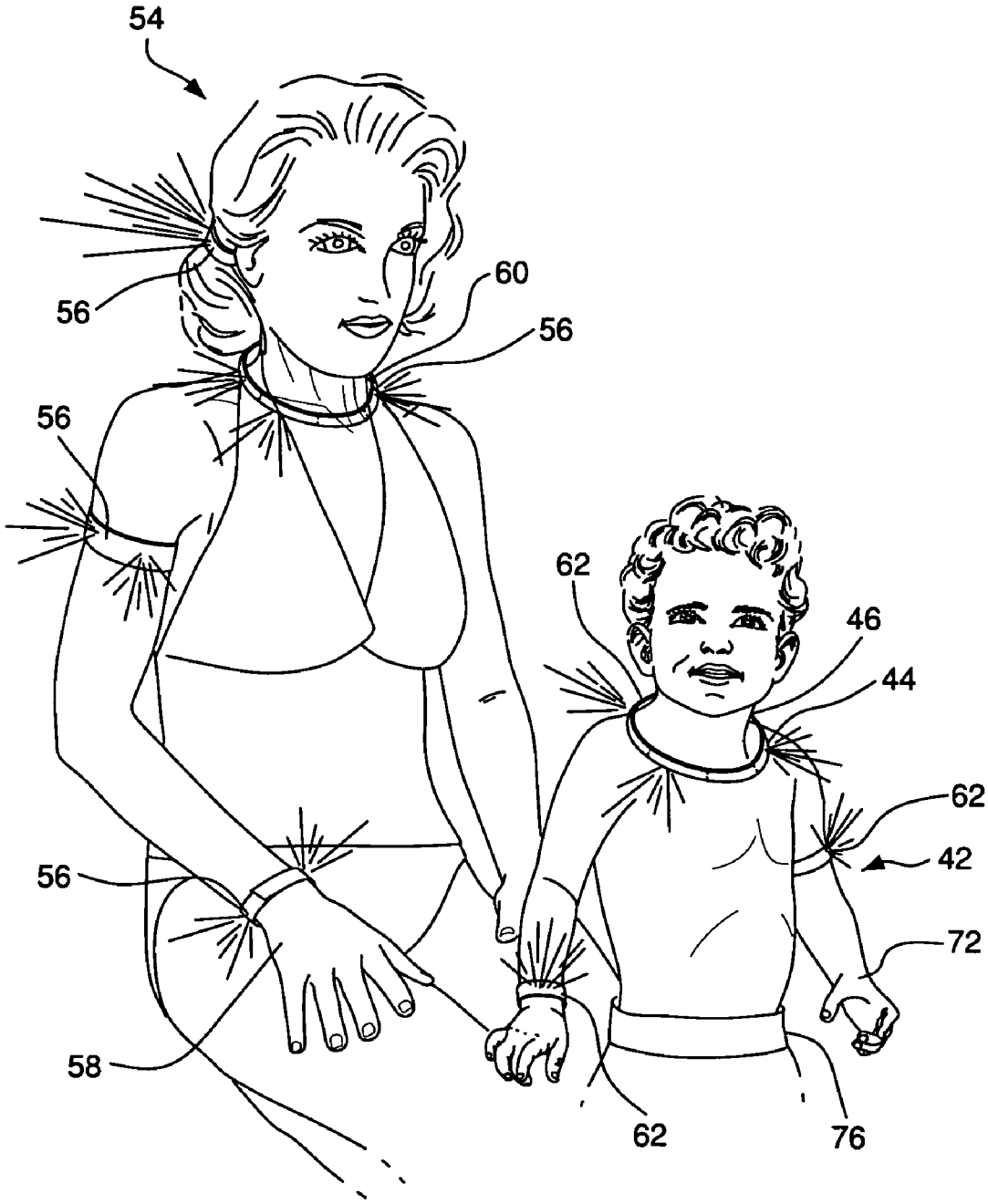
FIG. 11 shows a guardian and child utilizing the locator and monitoring system of the present invention.

A first or first set of bands 12 are provided as guardian bands 56, and are to be retained by a guardian 54 who is monitoring a child 42, as shown in FIGS. 6 and 11. A guardian band 56 can be formed in various user-selected sizes, and may be worn on the neck as a necklace, hair as a hairband, or wrist as a wristband, as shown in FIG. 11. The guardian band 56 may also be maintained as flat, and pinned or otherwise affixed to an item of clothing or an item such as a purse. In a preferred embodiment, the guardian band 56 is sized to fit around either the wrist 58 of a guardian 54, acting as a bracelet, or sized to fit around the neck 60 of the guardian 54, acting as a necklace.

Figure 7:
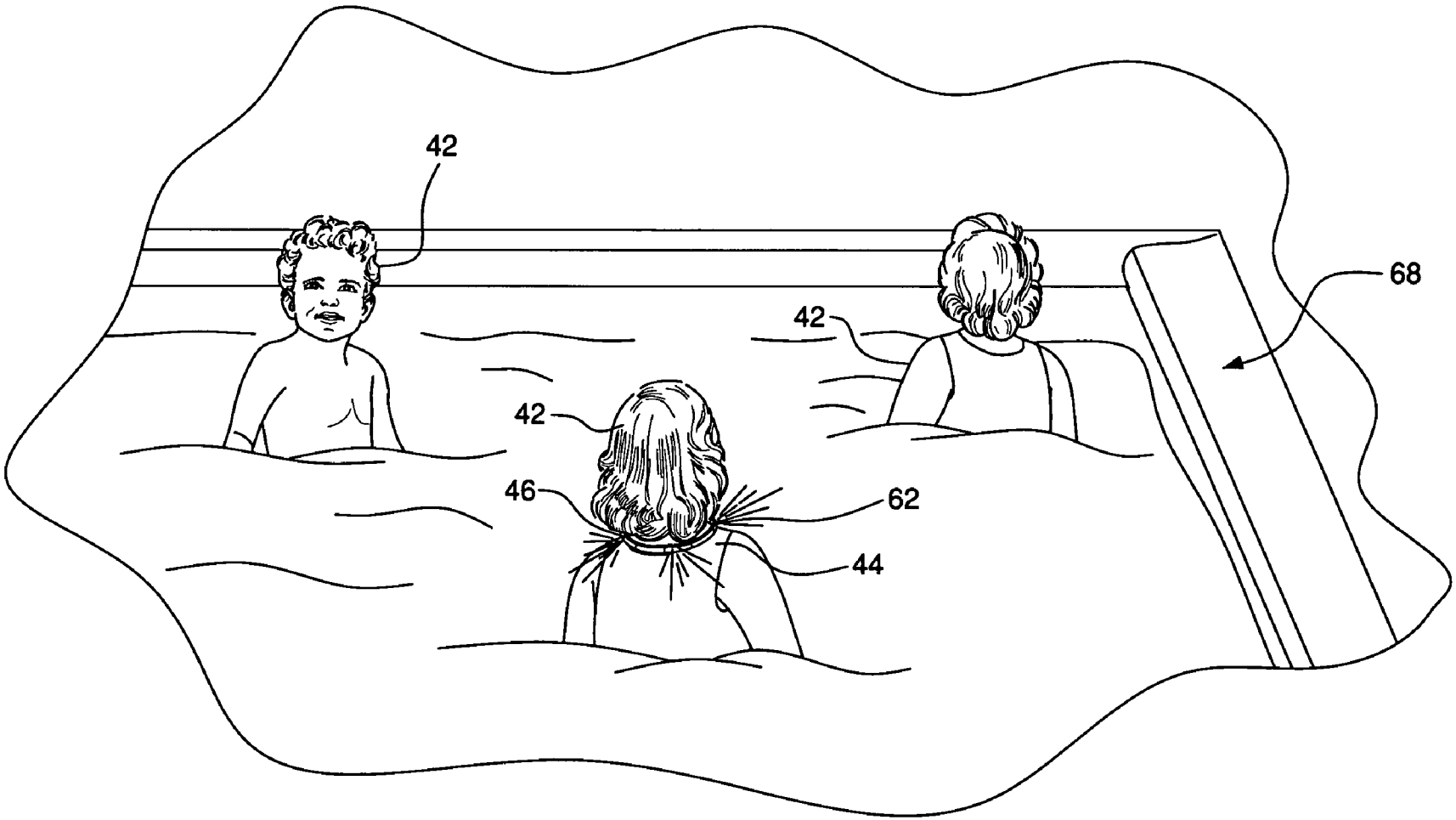
FIG. 7 shows a child utilizing a band of the present invention in a swimming pool.

A second or second set of bands 12 are provided as child bands 62. The child bands 62 are worn by children 42 who are being monitored, as shown in FIGS. 7, 8 and 11. Preferably, the child bands 62 are sized to be worn on a child's body above the waist 70, such as about the child's neck 46 as a necklace, as shown in FIGS. 7 and 8, and as discussed in greater detail below. The child bands 62 should range in size according to the range of children's neck sizes, which are approximately 8 inches to 16 inches. The present invention allows a guardian 54 to more easily identify, view, locate and/or track a child, as explained in detail below. Preferably, a child band 62 is formed from at least two segments 26, with score lines 24 dividing the segments 26.

In a preferred embodiment of the present invention, both the guardian bands 56 and the child bands 62 contain matching indicia 64. For example, the indicia 64 may be any combination of a particular color, graphic design, drawing, illustration, or numbers. If the guardian band 56 is, for example, the color purple, the matching child band 62, will also be the same color purple. If the guardian band 56 is, for example, a blue iridescent design, the child band 62 will are also be the same blue iridescent design. In this arrangement, the guardian 54 wearing the guardian band 56 can visually match the indicia 64 of the guardian band 56 with the indicia 64 of the child band 62. In addition, the guardian 54 will be reminded of the indicia 64 of the child bands 62. Each band segment 26 may be provided with a serial number that is the same for each segment 26, and matches a serial number on the guardian band 56.

At least a portion of the bands 12 may be formed from or coated with an iridescent, fluorescent, retroreflective, or highly reflective, material, whereby the material acts as the indicia 64. The indicia 64 may be formed, painted, affixed, glued, sprayed, or molded onto a band 12 when the band 12 is manufactured, or may be painted, applied, sprayed, glued, coated, or otherwise deposited on a face 16, 18 of the bands 12. The indicia 64 may be, by way of example, numbers, letters, slogans, graphics, text, colors, or any other visible markings. In the preferred embodiment, the guardian band 56 and child band 62 have matching indicia 64, which allows the guardian 54 and child 42 to "match-up" like bands 56, 62 and thereby, positively identify each other in a crowd of other people, as explained in detail below.

Figure 10:
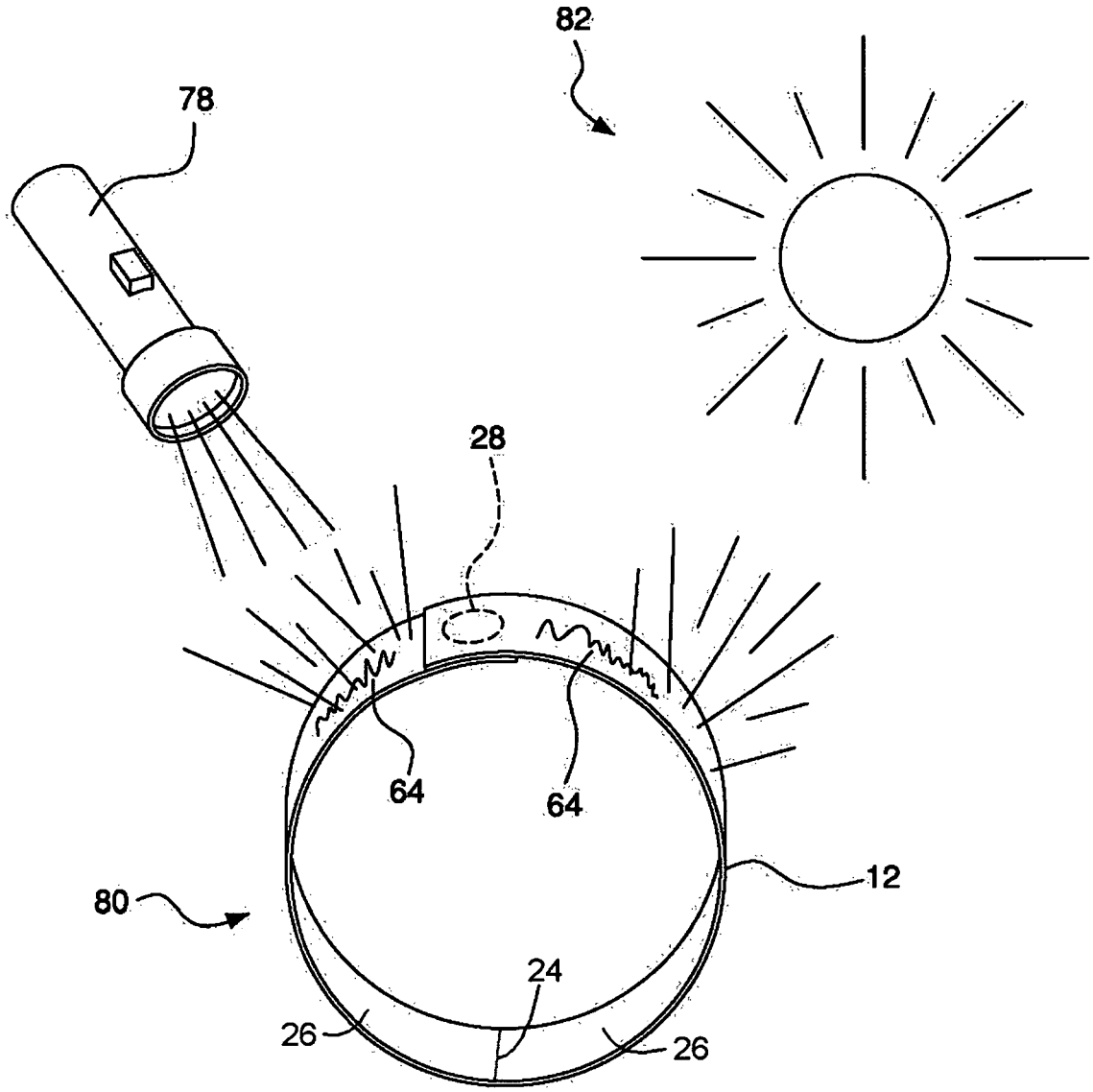
FIG. 10 shows a band of the present invention incorporating a highly reflective material, iridescent material, retroreflective material, metallic material, or fluorescent material, reflecting light from an light source or natural sunlight.

The bands 12 may also be formed from material, or coated or otherwise provided with a material, that is iridescent, fluorescent and/or highly reflective, so that light, such as sunlight 82, or from a light source 78 such as a flashlight, reflecting off of the surface of the band 12 will cause the band 12 to appear bright relative to its surroundings, making the band 12 more visually identifiable from a distance, as shown in FIGS. 6 and 10. Illustrative materials having desirable properties include CORDURA® by E.I. DuPont De Nemours, Wilmington, Del. or SCOTCHLITE® Reflective Material by 3M Company, or any other retroreflective, iridescent, highly reflective or fluorescent materials, making the bands 12 more visible from afar or in a crowd when light is reflected from the bands 12.

Retroreflective, iridescent, highly reflective, or fluorescent materials can reflect brightly in the sunlight 82, so these materials are preferred for forming or coating at least part of the bands 12, particularly when the guardian 54 and child 42 are at, for example, a beach 66 or swimming pool 68, or a park, theme park, or other outdoor activity such as camping. A retroreflective material that is also fluorescent and/or iridescent may be used. It is contemplated that any combination of more than one indicia 64 (i.e., color and iridescence; a graphic pattern and iridescence; an iridescent material and a retroreflective material; a retroreflective material and a fluorescent material) may be used in combination in forming or coating a band 12. Materials meeting the standards of the American National Standard for High-Visibility Safety Apparel and Headwear, ANSI/ISEA 107-2004, may also be used to form or coat the bands 12.

When at a swimming pool 68 or beach 66, children are often only visible from the waist 70 up, from behind and at a distance, as shown in FIGS. 6, 7 and 8, where at least some of the children's faces are not visible. In particular, the indicia of the bands 12 must be readily observable, and is preferably readily observable from a distance. For example, in most crowd situations, such as at a beach, swimming pool, amusement park, or other crowded event, children have a tendency to wander away from their guardians. It is easiest for a guardian to keep visual track of a child at closer distances, such as at less than approximately five (5) to twenty (20) feet. However, once a child is beyond approximately five (5) to twenty (20) feet, it is much more difficult for a guardian to easily locate or monitor the child. The present system, by incorporating indicia that is readily observable from a distance, provides a solution to the problem of children wandering away from a guardian. Because the bands 12 may be provided with indicia 64 that is highly visible, a guardian can easily identify a child wearing a band 12 from a distance, saving the guardian time, energy, and perhaps most significantly, emotional worry. Preferably, the indicia 64 is highly visible and/or readily observable from a distance when viewed from several different directions and angles. In a preferred embodiment, the indicia 64 is highly visible and/or readily observable from a distance when viewing the bands 12 from two opposing sides.

In the preferred embodiment, the child bands 62 are sized so that they adapted to be worn above the waist 70, preferably, around the neck 46 as shown in FIGS. 6, 6*a*, 7, 8 and 9 Therefore, the openings 38 of the loops 22 formed by the child bands 62 are preferably 8 inches to 16 inches in diameter. The width of a band 12 is preferably between 0.5 and 4 inches, although it is appreciated that the width may be varied according to the needs of a user. The bands 12 may be sized to be worn about the wrists, arms, waist, legs, hair, and therefore, the size, dimensions and width may be varied, as shown in FIG. 11. In the embodiments shown in the Figures, the length of the band 12 is selected by a user to meet the user's specific preferences. The bands 12 may be sized by tearing the bands 12 along the score lines 24, providing an easy means for sizing the bands 12.

The bands 12 may be formed from an expandable and/or stretchable and/or elastic material, such as a plastic, nylon, LYCRA®, SPANDEX®, or NEOPRENE®. The inner surface 18 of the band 12 contacting the user's skin should preferably be comfortable against the skin. The material of at least the outer surface 16 should preferably be weather and dirt resistance (such as coated, laminated or formed from a dirt or water resistant material) so as to prevent the indicia 64 from wearing. The material, particularly of the outer surface 16, is preferably water-proof and/or water-resistant so that the bands 12 will not be damaged or rendered unusable in water. In addition, at least a portion of the bands 12 may be formed from a buoyant material and thus adapted to enable the bands 12 to float in water. As discussed above, the child bands 62 are formed having score lines 24 that allow the child bands 62 to breakaway under a choking force that would choke or injure a child.

The bands 12 of the present invention may be used in several ways for monitoring a child. Referring to the embodiment shown in FIGS. 1, 2 and 7, upon attending a swimming pool 68 or beach 66 for example, a guardian 54 will size a length of band 12 from, for example, a roll 22 to act as a guardian band 56. The guardian 54 will, secure the guardian band 56 about the guardian 54's body, hair, clothing, or an item such as a beach or pool chair. The guardian 54 will also size a length of band 12 to act as a child band 62 for securing about a child's neck 46, or about the child's forehead (as a headband), upper arm (as an arm band), or hair (as a hair band), so that the child band 62 is readily observable from afar or in a crowd when a child is visible only from the waist up. The fasteners 28 are used to close the ends 14 of the guardian band 56 and the child band 62.

Figure 6A:
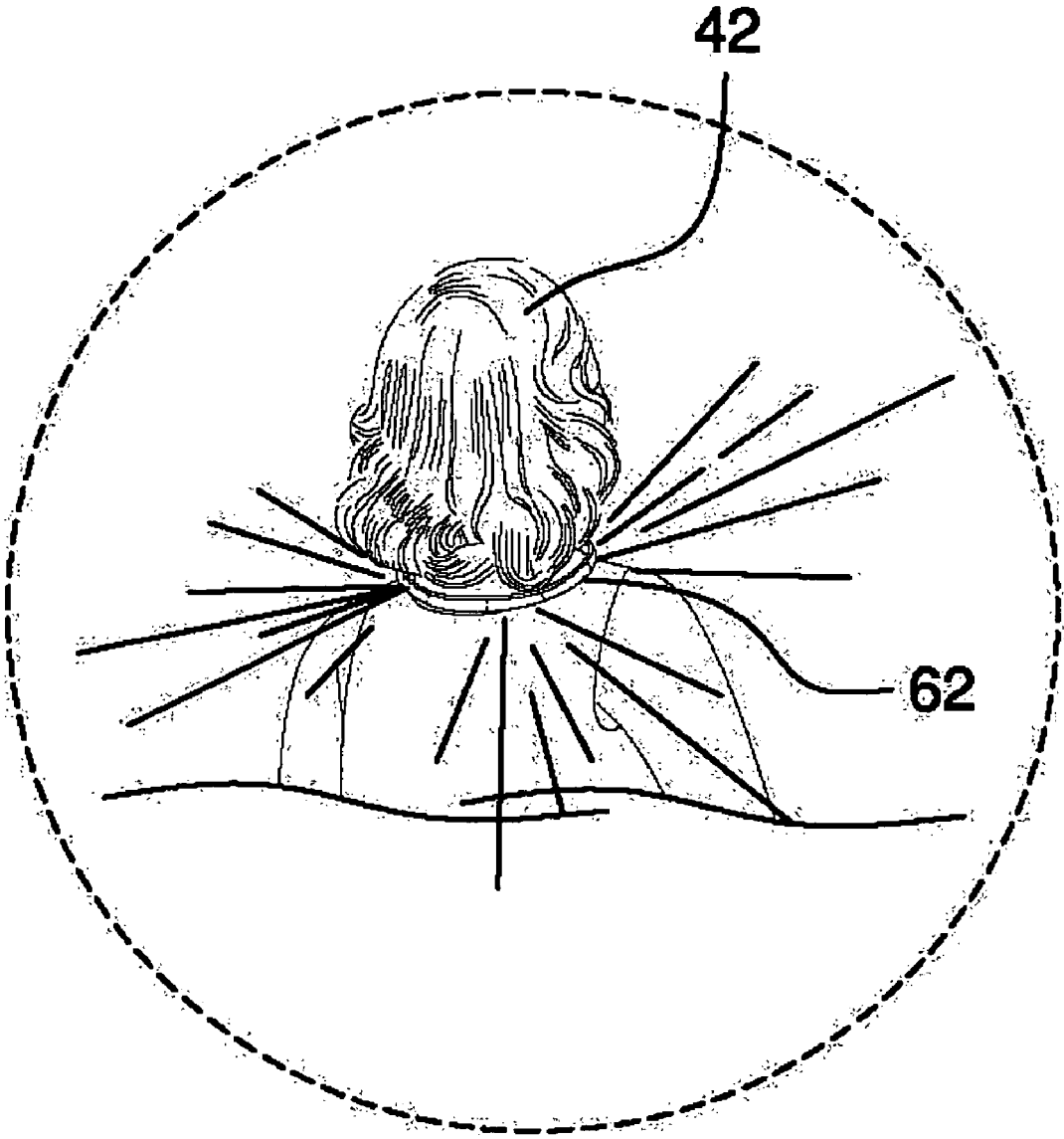
FIG. 6*a* is a close-up view of the child shown in FIG. 6 utilizing the bands of the present invention.

The guardian 54 and child 42 engage in their respective activities, as shown by way of example in FIGS. 6 and 6*a*. The guardian 54 is able to more easily observe and/or locate the child 42 by looking for the child band 62, which, because of its indicia, (color, images, high reflectivity, retroreflectivity, iridescence, fluorescence, or any combination thereof), visibly distinguishes the child 42 from other children in the public or crowded area. The indicia 64 preferably includes at least a portion that is readily observable at a distance. In addition, the indicia 64 is readily observable from a distance when viewed from multiple directions or angles, so regardless of the orientation of a child 42 wearing a child band 62, the child band 62 can seen by a guardian 54. In a preferred embodiment, the indicia 64 is readily observable from a distance when viewing the bands 12 from at least two opposing sides. For example, in FIGS. 6, 6*a*, 7 and 8, the indicia 64 of the child bands 62 can be seen when viewing a child 42 from behind (from the back of the child 42). FIGS. 9 and 11 show the indicia 64 of the child bands 62 viewed when viewing the child 42 from the front (from the front of the child 42).

If more than one child is wearing a child band 62 according to the present invention, that children may be distinguished by, for example, different colored child bands 62 or child bands 62 having other distinct indicia. Because the child band 62 is worn above the waist 70, and preferably around the neck 46, even when the child 42 is in a swimming pool 68 or at the beach 66, or facing away from the guardian 54, the child band 62 will be visible. If the child band 62 becomes caught or otherwise might choke the child 42, the child band 62 will tear at one of the score lines 24. In that case, the guardian 54 can size another length of band 12 as a child band 62 from the roll 22, and affix the child band 62 about the child's neck 46 or other body part.

In the embodiment of the present invention shown in FIGS. 5*a*, 5*b*, and 8, upon attending a swimming pool 68 or beach 66 area, the guardian 54 will obtain the combination band 48, which includes a guardian band 56 and child band 62. The guardian 54 will detach the guardian band 56 from the circular band 36. The guardian 54 will secure the guardian band 56 about their wrist, hair, clothing, beach chair, or other body part or item. The guardian 54 will select, for example, a circular band 36 shown in FIG. 5*a* with an appropriately sized opening 38 and will place the circular band 36 over the child's head 40, whereby the circular band 36 rests about the child's neck 46, and upon the child's shoulders 44, as shown in FIGS. 6, 8 and 9. With regard to the embodiment shown in FIG. 5*b*, a guardian 54 will separate the first band 92 from the cross band 50, and form the first band 92 into a loop to serve as a child band 62. The cross band 50 will serve as a guardian band 56.

Figure 12:
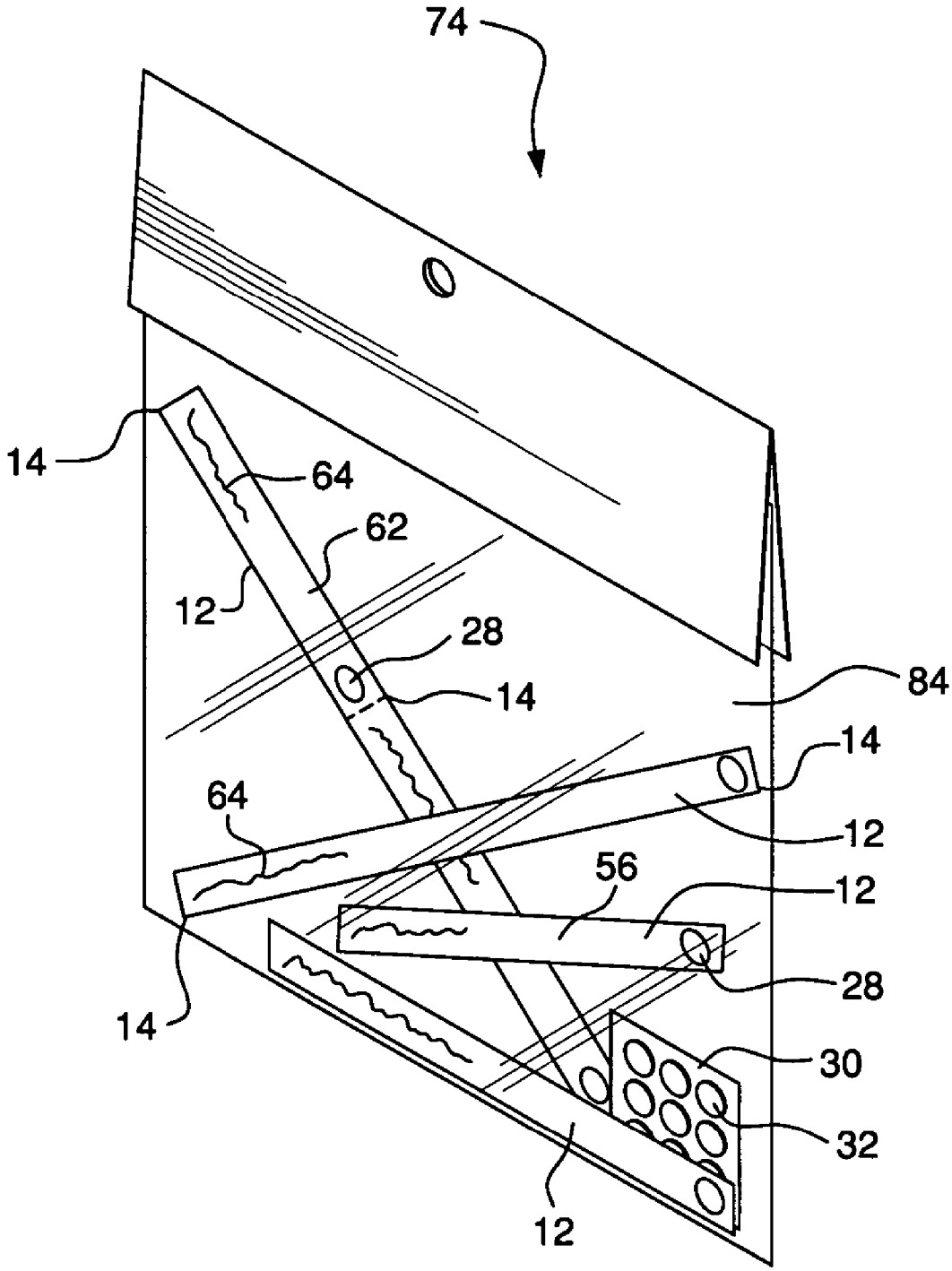
FIG. 12 shows one embodiment of a kit according to the present invention.

It is contemplated that the locator and monitoring system 10 of the present invention may be offered in a kit 74 packaged in plastic packaging 84. In one embodiment shown in FIG. 12, a plurality of bands 12 are provided of varying sizes and including various indicia. At least one set of guardian bands 56 and child bands 62 having matching indicia 64 are included in the kit 74. Preferably, sets of guardian bands 56 and child bands 62 having matching indicia 64 are included, such as a yellow fluorescent guardian band 56 and also a matching yellow fluorescent child band 62. A sheet 30 of fasteners 28 may be included in the kit 74. Alternately, fasteners 28 may be provided on the bands 12.

Figure 13:
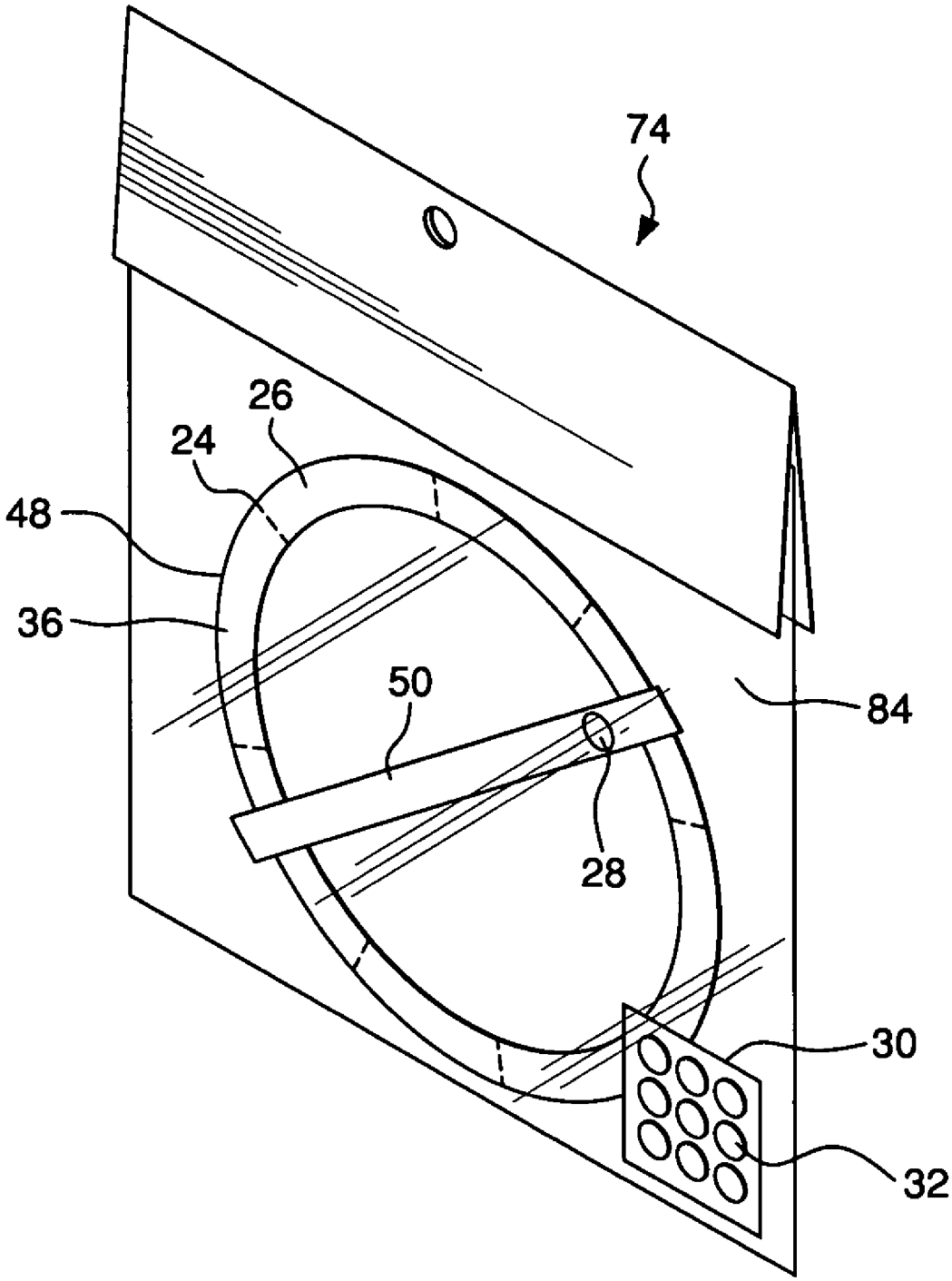
FIG. 13 shows another embodiment of a kit according to the present invention.

In another embodiment of the kit 74, as shown in FIG. 13, the kit 74 includes one or more combination bands 48. Each combination band 48 will have, for example, a circular bands 36 and a cross band 50 (guardian band 56) with matching indicia 64. If a plurality of combination bands 48 are provided, each combination band 48 may have a different set of indicia 64, to provide variety. A combination of bands 12 provided as strips, and combination bands 48 may be included in one kit 74 to provide variety.

Figure 14:
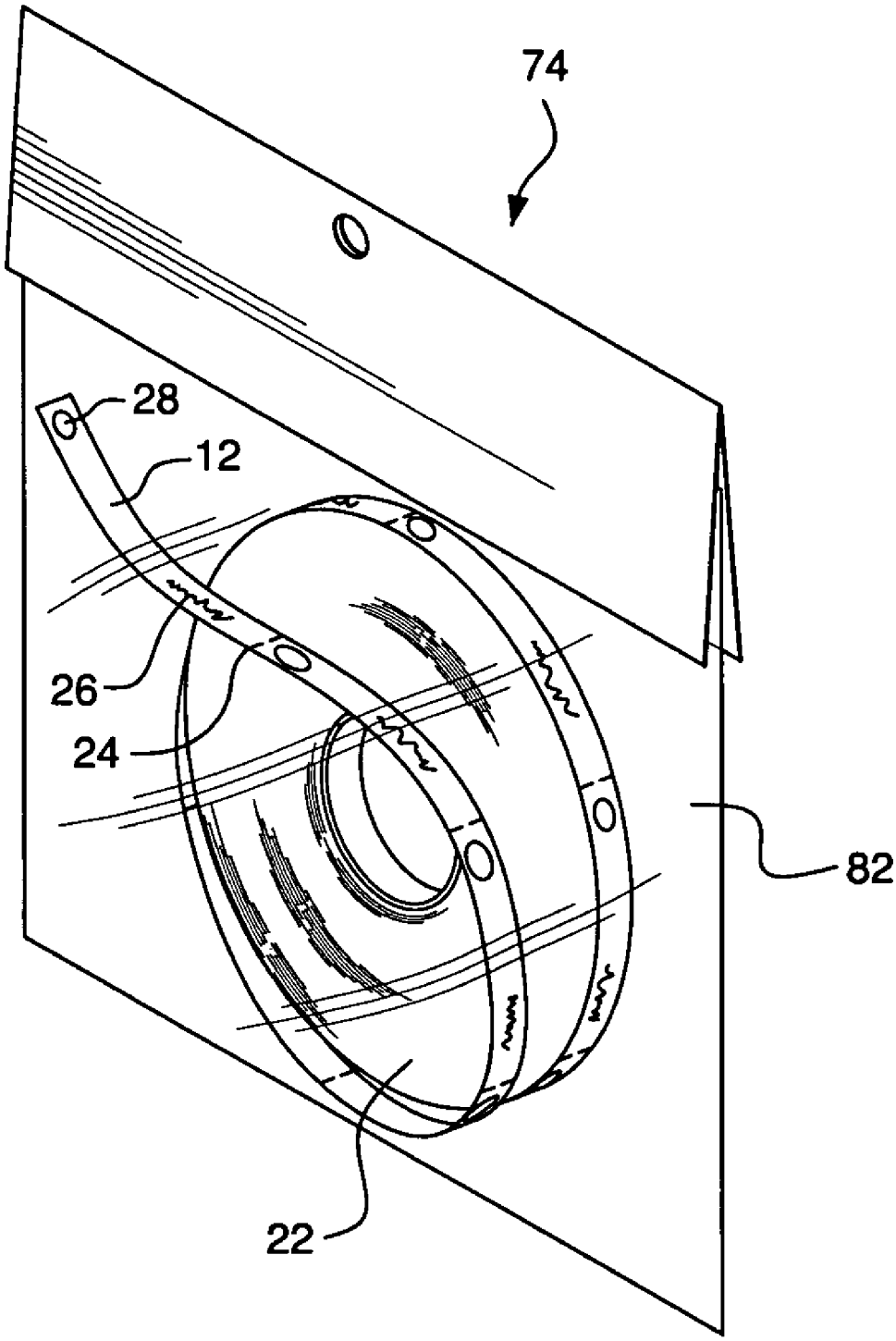
FIG. 14 shows another embodiment of a kit according to the present invention.

In another embodiment of the kit 74, as shown in FIG. 14, the bands 12 are provided on a roll 22. A guardian 54 may size guardian bands 56 and child bands 62 from the roll 22 of bands 12, to selected lengths. The roll 22 may include fasteners 28, or a sheet 30 of fasteners 28 may be provided in the kit 74. A guardian 54 may size various guardian bands 56 and child bands 62 from the roll 22 and the fasteners 28. The roll 22 may be formed with indicia 64 repeating for a certain number (n) of segments 26, and then different indicia 64 will appear for a certain number (n) of segments 26. For example, the roll 22 may have yellow fluorescent indicia for twenty band segments 26, iridescent indicia for the next twenty segments 26, white retroreflective indicia for the next twenty segments 26, and so forth.

Figure 15:
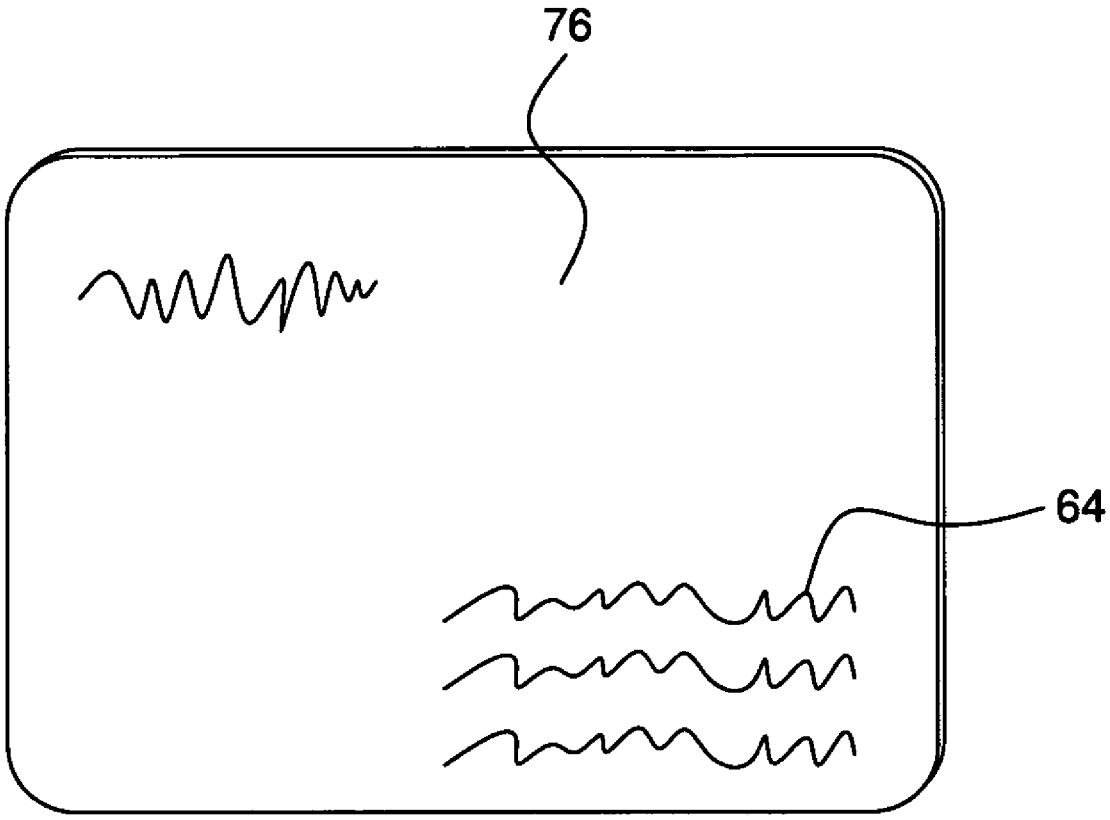
FIG. 15 shows a card according to the present invention.

In another embodiment, a kit 74 may include a card 76 shown in FIG. 15. The card 76 may be used by the guardian 54 to enter information which may be useful in monitoring a child 42, such as what the child is wearing, the location of the swimming pool 68 or beach 66 or other area, the child's vital statistics, etc. The card 76 itself may have a side having indicia 64 matching the indicia 64 of the guardian band 56 and the child band 62, for example, if a the guardian band 56 and a child band 62 have yellow fluorescent or iridescent indicia, the card 76 will have matching yellow fluorescent or iridescent indicia 64.

It is appreciated that the card 76 need not be a "pocket sized" card such as included in a small kit 74, but may be a larger or "poster sized" card 76. In that manner, the card 76 may have indicia 64 matching indicia of the guardian bands 56 and the child bands 62. When a group including children and guardians is out on a class trip or other activity, a member of the group may hold up the card 76 to rally those with matching indicia 64 to gather about the member holding the card 76. Thus, a unique method of gathering a group of guardians and/or children to a rallying point is provided by the present invention.

Where a retroreflective material is used as part of the indicia 64, a flashlight 78 may be provided as part of the kit 74 for use by the guardian 54. Because retroreflective material is most visible from the source of light hitting the retroreflective materials, a guardian 54 would hold the flashlight is held at eye level when attempting to locate a child 42 being monitored.

The locator and monitoring system 10 of the present invention has many advantages, most significantly ready visual recognition of children who have moved away from a monitored location, ready visual identification of children who, though remaining in a monitored location, are within a crowd of other non-children, low-cost of manufacture, safety, adjustability, and comfort.

Although the invention has been described and illustrated with respect to the exemplary embodiments thereof, it should be understood by those skilled in the art that the foregoing and various other changes, omissions and additions may be made therein and thereto, without parting from the spirit and scope of the present invention.

Having thus described in detail several embodiments of the present invention, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiments are possible which do not alter, with respect to those parts, the inventive concepts and principles embodied therein. The present embodiments and optional configurations are therefore to be considered in all respects as exemplary and/or illustrative and not restrictive, the scope of the invention being indicated by the appended claims rather than by the foregoing description, and all alternate embodiments and changes to the embodiments which come within the meaning and range of equivalency of said claims are therefore to be embraced therein.

What is claimed is:

1. A locator and monitoring system for u by a guardian in visually identifying a child, comprising:

a length of band having indicia on at least one surface thereof, the length of band having score lines at intervals along the length of band, the score lines dividing the length of band into segments, whereby the length of band is adapted to be divided along the score lines into:

at least one first band to be worn by a guardian, and, at least one second band to be formed into a loop and worn by a child being monitored by the guardian above the child's waist for visually identifying the child when the child is only visible from the waist up; wherein the at least one first band and the at least one second band have matching indicia; and, wherein the at least one second band can be torn along the score lines when a choking or strangulation force is applied to the at least one second band.

2. The locator and monitoring system of claim 1, wherein at least a portion of the indicia is reflective.

3. The locator and monitoring system of claim 1, wherein at least a portion of the indicia of the at least one second band is observable from at least two opposing directions.

4. The locator and monitoring system of claim 1, wherein the indicia comprises a combination of any of graphics, text, letters, numbers, retroreflective material, iridescent material, fluorescent material, and reflective material.

5. The locator and monitoring system of claim 1, wherein at least a portion of the indicia is fluorescent.

6. The locator and monitoring system of claim 1, wherein the at least one second band is sized and dimensioned to be worn by a child adjacent the child's shoulders.

7. The locator and monitoring system of claim 1, further comprising at least one fastener adjacent an end of at least one segment to form a selected length of band into a loop.

8. A locator and monitoring system for use by a guardian in visually identifying a child, comprising:

at least one first band having indicia on at least one surface thereof, the at least one first band having score lines at intervals along a length thereof, the score lines dividing the at least one first band into segments, the at least one first band adapted to be sized by removing segments of the at least one first band, the at least one first band having at least one fastener adjacent an end thereof for forming the at least one first band into a loop;

at least one second band having indicia matching the indicia of the at least one first band on at least one surface thereof, the at least one second band having score lines at intervals along a length thereof, the score lines dividing the at least one second band into segments, the at least one second band adapted to be sized by removing segments of the at least one second band, the at least one second band having at least one fastener adjacent an end thereof for forming the at least one second band into a loop;

wherein the at least one first band is adapted to be formed into a guardian band to be worn by a guardian monitoring a child, wherein the at least one second band is sized and dimensioned to be formed into a child band to be worn above a waist of a child being monitored for visually identifying the child when the child is only visible from the waist up.

9. The locator and monitoring system of claim 8, wherein at least a portion of the indicia is reflective.

10. The locator and monitoring system of claim 8, wherein the at least one second band can be torn along the score lines when a choking or strangulation force is applied to the at least one second band.

11. The locator and monitoring system of claim 8, wherein the at least one second band is sized and dimensioned to be worn by a child adjacent the child's shoulders.

12. A kit for assisting a guardian in monitoring or locating a child, the kit comprising:

a length of band having indicia on at least one surface thereof, the length of band having score lines at intervals along the length of band, the score lines dividing the length of band into segments, whereby the length of band is adapted to be divided along the score lines into:

at least one first band to be worn by a guardian;

at least one second band to be worn by a child being monitored by the guardian above the child's waist for visually identifying the child when the child is only visible from the waist up; and, a package for holding the length of band;

wherein the at least one first band and the at least one second band have matching indicia;

wherein at least a portion of the indicia is readily observable from a distance; and, wherein the at least one second band can be torn along the score lines when a choking or strangulation force is applied to the at least one second band.

13. The kit of claim 12, wherein the length of band is formed as a roll.

14. The kit of claim 12, wherein at least a portion of the indicia is highly reflective.

15. The kit of claim 12, further comprising a card for recording information, wherein at least a portion of the card has indicia matching the indicia of the length of band.

16. A method of assisting a guardian with monitoring or locating a child, the method comprising: obtaining a length of band having indicia on at least one surface thereof, the length of band having score lines at intervals along the length of band, the score lines dividing the length of band into segments; sizing at least one first band to be worn by a guardian from the length of band by tearing the length of band along selected score lines; sizing at least one second band to be worn by a child above the child's waist from the length of band by tearing the length of band along selected score lines; forming the at least one second band into a loop positioned about one of a child's neck, a child's upper arm and a child's hair.

17. The method of assisting a guardian with monitoring or locating a child according to claim 16, wherein the at least one second band can be torn along the score lines when a choking or strangulation force is applied to the at least one second band.

* * * * *